US007998342B2

(12) United States Patent
Duyvesteyn et al.

(10) Patent No.: US 7,998,342 B2
(45) Date of Patent: Aug. 16, 2011

(54) SEPARATION OF TAILINGS THAT INCLUDE ASPHALTENES

(75) Inventors: Willem P. C. Duyvesteyn, Reno, NV (US); Julian Kift, Reno, NV (US)

(73) Assignee: Marathon Oil Canada Corporation, Calgary, Alberta (CA)

( * ) Notice: Subject to any disclaimer, the term of this patent is extended or adjusted under 35 U.S.C. 154(b) by 464 days.

(21) Appl. No.: 11/971,046

(22) Filed: Jan. 8, 2008

(65) Prior Publication Data

US 2008/0156702 A1 Jul. 3, 2008

Related U.S. Application Data

(63) Continuation-in-part of application No. 11/371,327, filed on Mar. 7, 2006, now Pat. No. 7,585,407.

(51) Int. Cl.
*C10G 1/04* (2006.01)

(52) U.S. Cl. ..... 208/390; 208/391; 208/425; 208/309; 208/86

(58) Field of Classification Search ..... 208/390, 208/391
See application file for complete search history.

(56) References Cited

U.S. PATENT DOCUMENTS

| | | | | |
|---|---|---|---|---|
| 2,871,180 | A | 1/1959 | Lowman, Jr. et al. | |
| 3,159,571 | A * | 12/1964 | Reman et al. | 208/39 |
| 3,303,122 | A * | 2/1967 | Doelman | 208/45 |
| 3,779,902 | A | 12/1973 | Mitchell et al. | |
| 4,325,818 | A * | 4/1982 | Woodle | 208/326 |
| 4,539,097 | A * | 9/1985 | Kelterborn et al. | 208/390 |
| 4,572,777 | A * | 2/1986 | Peck | 208/390 |
| 6,007,709 | A * | 12/1999 | Duyvesteyn et al. | 208/391 |
| 2004/0007500 | A1 * | 1/2004 | Kresnyak | 208/187 |
| 2004/0035755 | A1 | 2/2004 | Reeves | |

OTHER PUBLICATIONS

International Searching Authority "Notification of Transmittal of the International Search Report and the Written Opinion of the International Searching Authority" Feb. 5, 2009.

* cited by examiner

*Primary Examiner* — Glenn A Caldarola
*Assistant Examiner* — Michelle L Stein
(74) *Attorney, Agent, or Firm* — Holland & Hart LLP

(57) ABSTRACT

Various systems and methods are described that can be used as part of a process to separate bitumen from oil sands. The process may include adding a hydrocarbon solvent to a bitumen containing extract. The tailings from this process may contain a significant amount of solvent. The solvent may be recovered from the tailings with a tailings solvent recovery unit that utilizes negative pressure to significantly reduce the cost of the process in comparison to a conventional steam stripping unit. In one embodiment, the tailings may also separated prior to entering the tailings solvent recovery unit with a gravity separation apparatus or a cyclonic separation apparatus, such as a hydrocyclone.

27 Claims, 4 Drawing Sheets

SEPARATION OF TAILINGS THAT INCLUDE ASPHALTENES

CROSS-REFERENCE TO RELATED PATENT APPLICATIONS

This patent application is a continuation-in-part of U.S. patent application Ser. No. 11/371,327, entitled "Processing Asphaltene-Containing Tailings," filed on 7 Mar. 2006 now U.S. Pat. No. 7,585,407, published on 13 Sep. 2007 as U.S. Patent Application Publication No. 2007/0209971 (referred to herein as the '327 Application), the contents of which are hereby incorporated by reference herein in its entirety.

OTHER RELATED PATENTS

U.S. Pat. No. 6,007,709 (the '709 patent), entitled "Extraction of Bitumen From Bitumen Froth Generated From Tar Sands," issued on 28 Dec. 1999, is hereby incorporated by reference herein in its entirety.

In the event of a conflict, the subject matter explicitly recited or shown herein controls over any subject matter incorporated by reference. All definitions of a term (express or implied) contained in any of the subject matter incorporated by reference herein are hereby disclaimed only to the extent, that such definitions are inconsistent with or narrower than the understanding of the term as used herein. The paragraphs shortly before the claims dictate the meaning to be given to any term explicitly recited herein subject to the disclaimer in the preceding sentence.

BACKGROUND

Oil sands, tar sands, or bituminous sands are common names of geological formations that contain bitumen, an extremely heavy type of crude oil. Oil sands can have a variety of compositions but typically include, in addition to the bitumen, water and mineral solids. The mineral solids can include coal and inorganic solids such as coal, sand, and clay. Significant deposits of oil sands can be found in North America. One of the largest oil sands deposits is in the Athabasca region of Alberta, Canada. In the Athabasca region, the oil sands formation can be found at the surface, although it may be buried as deep as two thousand feet below the surface overburden. The oil sands deposits are measured in barrels equivalent of oil. It is estimated that the Athabasca oil sands deposit contains the equivalent of about 1.7 to 2.3 trillion barrels of oil. Global oil sands deposits have been estimated to contain up to 4 trillion barrels of oil. By way of comparison, the proven worldwide oil reserve is estimated to be about 1.3 trillion barrels.

The bitumen, content of oil sands varies from approximately 5 wt. % to 21 wt. %, with a typical content of approximately 12 wt. %. Oil sands also include approximately 1 wt. % to 10 wt. % water. The remainder is mineral matter such as coal, sand, and clay. Bitumen is best described as a thick, sticky form of crude oil that is so heavy and viscous that it will not flow unless heated or diluted with lighter hydrocarbons. At room temperature, bitumen is much like cold molasses.

In the past, bitumen has been extracted from oil sands using a number of technologies. Typical oil sands extraction processes can be divided into two categories: in-situ processes and mining processes. The in-situ processes don't require removal of the oil sands to a processing facility. Instead, bitumen is extracted directly from the oil sands. Typical in-situ processes involve heating the oil sands by injecting steam or in some other suitable manner and then pumping the bitumen out like conventional crude oil.

Mining processes, require excavation and removal of the oil, sands to a processing facility where the bitumen is extracted. For example, a typical mining process may include excavating the oil sands and mixing them with heated water and, optionally, a process aid such as caustic soda (NaOH) which is then piped as a slurry to the extraction plant. Alternatively, the oil sands may be trucked to the extraction plant where the ore is mixed with heated water and/or one or more process aids. Once at the plant, the mixture is agitated to form a bitumen enriched froth. The combination of hot water and agitation releases bitumen from the tar sand, and allows small air bubbles to attach to the bitumen droplets. The bitumen froth floats to the top of separation vessels and is separated for further processing. The bulk of the mineral solids are removed from the bottom of the separation vessels for further processing or disposal. In some processes, middlings may also be removed from a mid-portion of the separation vessels for further processing to isolate bitumen.

The bitumen froth is treated further to remove air from the froth and, to separate the bitumen from residual mineral solids, water, etc. The air may be removed by heating the froth. The bitumen product may be separated from the froth using the counter-current decantation (CCD) process described in the '709 patent, or alternatively with centrifuges. A hydrocarbon solvent is typically added to modify the viscosity of the bitumen and to otherwise facilitate separation of the bitumen. Separation of the froth yields a bitumen product that can be refined similarly to conventional crude oil and tailings that include mineral solids, water, solvent, precipitated asphaltenes, and some residual bitumen.

The tailings, undergo further processing to separate as much solvent as is feasible. The recovered solvent can either be recycled back to the process or otherwise disposed. As an example, the tailings (i.e., the underflow from the CCD circuit) from a process such as the one described in the '709 patent can include 0.5 wt. % to 10 wt. % solvent, or, more likely, 0.75 wt. % to 2 wt. %. The amount of solvent in the tailings may represent approximately 2 wt. % to 10 wt. % of the total solvent used to separate the bitumen. It is desirable to separate as much solvent as possible in order to increase the economics of the process and to meet environmental regulations governing the disposal of the tailings. It should be noted in this regard, that the solvent in the tailings includes free solvent that is not chemically or physically bound to any other component and bound solvent that is chemically and/or physically bound to other components such as asphaltenes. Therefore, it should be recognized that it is desirable to recover as much of the remaining solvent as possible even while recognizing that some amount of solvent will remain bound to and discharged with the asphaltenes.

Current techniques for processing the tailings suffer from a number of deficiencies. For example, in many situations, the tailings are initially separated to remove some of the mineral solids. Unfortunately, these separation operations do not remove as much of the mineral solids as would be desirable. The mineral solids that remain in the water and solvent mixture can adversely impact downstream unit operations such as steam stripping units used to recover the solvent. The abrasive mineral solids in the tailings often lead to extremely high component wear rates of the steam stripping unit, which results in frequent maintenance and high operating costs.

The use of steam stripping to recover the solvent presents a host of other problems. Steam stripping is very energy intensive and expensive to operate. The steam stripping process may account for as much as 5% to 40% of the total operation extraction operating costs. Much of this expense arises from heating the tailings. Another problem associated with conventional tailings solvent recovery units is that they may not fully separate the solvent resulting in significant amounts of solvent being lost. In some situations, there is so much solvent left in the tailings that the tailings pond is at risk of catching fire. Another potential problem is that after being stripped, the asphaltenes may readily reabsorb the solvent. It would be desirable to increase the solvent recovery rate and thereby reduce the amount of solvent in the final disposed tailings.

Another source of problems is the presence of precipitated asphaltenes in the tailings. Asphaltenes are high molecular weight hydrocarbons having a chemical structure that can include stacks of condensed aromatic rings. Due to their high molecular weight, asphaltenes can be found within the least volatile fraction of the bitumen. The problems associated with precipitated asphaltenes can be overcome by using a solvent that does not appreciably precipitate the asphaltenes such as naphtha. However, this presents it own set of problems due to the difficulty of separating naphtha from the tailings. It is desirable to use a more volatile hydrocarbon solvent so that separation of the solvent is easier and less energy intensive.

SUMMARY

A variety of embodiments are described herein of systems and methods for extracting bitumen from oil sands. In particular, an improved system and process is disclosed for treating and recovering solvent from the tailings generated during the extraction of the bitumen. It should be appreciated that the techniques, systems, and processes described herein may be applicable to any of a number of aspects of bitumen extraction. For example, the systems and processes, described as being useful to treat the tailings may also be useful to treat other streams generated as part of the process of extracting the bitumen. It should be, appreciated that the techniques, systems, and processes described herein may be applicable to both continuous, batch, or semi-batch processes. Also, the term stream is meant to encompass material that is processed either continuously or batch-wise and is not, meant to imply a continuous process. Thus the term stream can apply to continuous, batch, and semi-batch processes.

In one embodiment, the bitumen is extracted from the oil sands using a CCD process similar to that described in the '709 patent. The process may include mixing oil sand with water to form a bitumen froth. The bitumen froth may be removed and separated into a bitumen product stream and a tailings stream using a CCD circuit. The tailings may be separated using one or more cyclonic Separation apparatuses and/or gravity separation apparatus. The cyclonic separation apparatuses and/or the gravity separation apparatuses may output three components: (1) a "clean" mineral solids component that also includes some water, (2) an asphaltene component that includes the bound solvent and some water, and (3) a light component that includes most, of the free solvent and, some water. The asphaltene component may go to further processing for solvent and/or oil recovery. The light component is processed with a tailings solvent recovery unit to isolate and recycle the solvent in the light component.

The system may include a cyclonic separation apparatus and/or a gravity separation apparatus to separate mineral solids such as coal, sand, and clay from the tailings. For example, a cyclonic separation apparatus, such as a hydrocyclone, may be used to initially separate the mineral. Additional cyclonic or gravity separation apparatuses may be positioned in series with the initial cyclonic separation apparatus to further separate the light or heavy component. In general, the cyclonic and/or gravity separation apparatuses may be used to divide the tailings into a light component that includes those components having a specific gravity greater than 1 (e.g., mineral solids such as sand, clay, and coal) and a heavy component that includes those components having a specific gravity less than or equal to 1 (e.g., water, asphaltenes, and solvent).

The light component—primarily a mixture of water solvent—is eventually fed to a tailings solvent recovery unit (TSRU) to separate and recover the solvent. The tailings solvent recovery unit may include a negative pressure separation unit such as a vacuum distillation unit or a vacuum stripping unit. Other suitable negative pressure separation units may be used such as vacuum filters (belt filter, plat and frame filters, etc.) and the like. The pressure in the negative pressure, separation unit is lowered to below atmospheric pressure to facilitate volatilization of the solvent. The negative pressure separation unit may provide significant savings in comparison to other technologies such as steam stripping.

The initial separation process performed on the tailings, preferably a cyclonic separation process, may be used to separate the tailings into a light component and a heavy component. The light component may include a majority of the free solvent from the tailings and the heavy component may include mineral solids. The light component may be further separated with another cyclonic separation apparatus and/or gravity separation apparatus. The heavy component may also be further separated with another cyclonic separation apparatus and/or gravity separation apparatus.

It should be appreciated that multiple cyclonic and/or gravity separation apparatuses may be positioned in series to facilitate greater separation of the tailings prior to being fed to the tailings solvent recovery unit. For example, two cyclonic separation, apparatuses may be positioned in series or one cyclonic separation apparatus and one gravity separation apparatus may be positioned in series. Depending on the size, the cyclonic and/or gravity separation apparatuses may also be positioned in parallel to process large quantities of tailings. At each separation apparatus, most of the free solvent reports to the light component and at least a portion of the mineral solids report to the heavy component. This separation can be repeated on one or both the light component or the heavy component with each subsequent step providing a greater degree of separation.

In one embodiment, the solvent may cause a fraction of the asphaltenes to precipitate. In this embodiment, the light component from the initial separation process may include a majority of the free solvent from the tailings and a majority of the asphaltenes from the tailings. The light component may be separated further using a cyclonic separation apparatus or a gravity separation apparatus to obtain another light component that includes a majority of the free solvent and a heavy component that includes a majority of the asphaltenes.

In one embodiment, the method may include separating tailings resulting from a process for recovering bitumen from oil sands into a first light component and a first heavy component with a cyclonic separation apparatus or a gravity separation apparatus. The first light component includes a majority of free hydrocarbon solvent in the tailings and a majority of asphaltenes in the tailings and the first heavy component includes mineral solids. The method further includes separating the first light component into a second light component and a second heavy component with cyclonic separation apparatus or a gravity separation apparatus. The second light component includes a majority of the free hydrocarbon solvent in the first light component and the second heavy component including a majority of the asphaltenes in the first light component.

In another embodiment, the method may include separating a slurry that is part of a process for recovering bitumen from oil sands with a hydrocyclone. The slurry includes asphaltenes, a majority of which have precipitated. In yet another embodiment, the method may include separating bitumen from oil sands and thereby forming tailings which may then be separated into a light component and a heavy component with a hydrocyclone. In yet another embodiment the method includes separating a stream that is part of a process for recovering bitumen from oil sands with a hydrocyclone. The stream includes a hydrocarbon solvent that is at least 50 wt. % paraffinic hydrocarbons having five to eight carbon atoms. One embodiment of a system may include one or more separation apparatuses configured to receive and separate bitumen from oil sands and thereby produce tailings that include hydrocarbon solvent and precipitated asphaltenes. The system may also include a hydrocyclone positioned to receive the tailings and separate the tailings into a light component and a heavy component.

It should be appreciated that the separation systems described herein may be used to make virtually complete separations between mixtures of solvent, water, and mineral solids (and any diluted bitumen that may be present). The method separates tailings with cyclonic and/or gravity separation apparatuses into a solids enriched heavy fraction (precipitated asphaltenes and/or mineral solids) and a free solvent enriched light fraction. Suitable cyclonic separation apparatuses include hydrocyclones or hydroclones and suitable gravity separation apparatuses include settlers, clarifiers, certain filters, and the like. Various known filter separation apparatuses may also be suitable. In the case of a gravity separation apparatus, the tailings are separated by allowing gravity settling of the components to form a solids enriched heavy fraction (precipitated asphaltenes and/or mineral solids), a water fraction with fine suspended mineral solids, and a free solvent enriched light component. The free solvent enriched light component can be easily recovered or further separated to increase the purity of the recovered solvent for in process recycle.

The foregoing and other features, utilities, and advantages of the subject matter described herein will be apparent from the following more particular description of certain embodiments as illustrated in the accompanying drawings.

DRAWINGS

DETAILED DESCRIPTION

Figure 1:
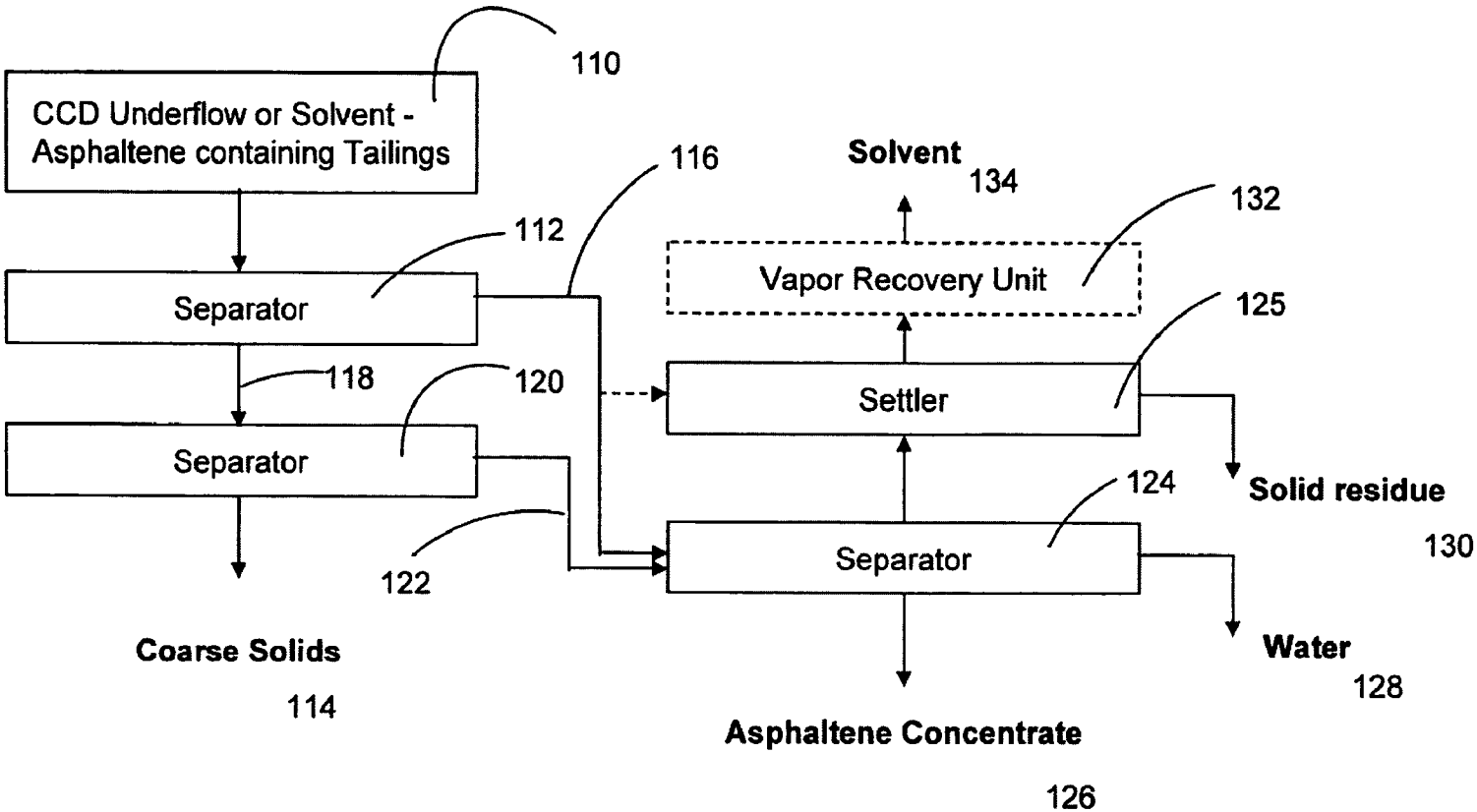
FIG. 1 is a schematic diagram representing embodiments, of a method and a system for recovering solvent or diluent from tailings produced using a Low Temperature froth Treatment Process (LTFT).

Unless otherwise explained, all technical and scientific terms used herein have the same meaning as commonly understood by one of ordinary skill in the art to which this disclosure belongs. The singular terms "a," "an," and "the" should be understood to include plural referents unless the context clearly indicates otherwise. Similarly, the word "or" is intended to include "and" unless the context clearly indicates otherwise. The term "includes" means "comprises." The method steps described herein, such as the separation steps and the mixing steps, can be partial, substantial or complete unless indicated otherwise. All percentages recited herein are dry weight percentages unless indicated otherwise.

Oil sands represent a valuable source of hydrocarbons in a world where such sources are becoming increasing scarce. Extraction of these hydrocarbons represents a significant opportunity to meet the ever increasing global demand for oil, gasoline, and other hydrocarbon based products (e.g., plastic, etc.). It should be appreciated that the terms oil sands and tar sands are used interchangeably to refer to a variety of compositions that include both bitumen and mineral solids. Oil sands typically include bitumen, water, and mineral solids such as coal, sand, and clay. The bitumen in oil sands typically includes a variety of relatively heavy hydrocarbons, resins, and asphaltenes. Depending on the composition, oil sands can have varying levels of hardness. Some oil sands are in the form of a rock-like ore. Other oil sands are generally granular and free-flowing. Upon separation from the mineral components of the oil sands, bitumen has many useful applications, especially as a feedstock for refining oil, gasoline, and other valuable commodities.

The following disclosure describes a number of embodiments of a system and method that can be used to separate tailings from a bitumen extraction process. The tailings may originate from any suitable process for extracting bitumen from oil sands. Preferably, the tailings are the underflow or heavy component from a CCD process such as that described in the '709 patent. In a CCD process, the oil sands ore is initially mixed with water in a flotation separation system to form a bitumen froth. The froth typically includes bitumen (including, precipitated and unprecipitated asphaltenes), water, mineral solids, and precipitated asphaltenes. The concentration of bitumen in the froth may be about 20 wt. % to 80 wt. % or about 40 wt. % to 70 wt. %. The concentration of water in the froth may be about 10 wt. % to 75 wt. % or about 15 wt. % to 40 wt. %. The concentration of mineral solids in the froth may be about 5 wt. % to 45 wt. % or about 5 wt. % to 20 wt. %. The concentration of asphaltenes in the froth may be about 1 wt. % to 25 wt. % or about 5 wt. % to 15 wt. %. A typical froth may include about 60 wt. % bitumen (asphaltenes make up about 18 wt. % of the bitumen), about 25 wt. % water, about 10 wt. % mineral solids and about 8 wt. % asphaltenes.

The froth is separated, deaerated (e.g., by heating), and mixed with a solvent that solvates most of the bitumen to enable it to be recovered from the oil sands ore. The solvent also causes some of the asphaltenes to precipitate (e.g., C5 asphaltenes are those asphaltenes that precipitate in pentane; C7 asphaltenes are those, asphaltenes that precipitate in heptane). The mixture is separated with a CCD circuit to isolate the bitumen product (commonly referred to as dilbit, which is short for diluted bitumen; the dilbit is primarily a mixture of solvent and bitumen).

The CCD circuit involves subjecting the solvent and the froth to multiple settling stages in a counter current fashion—i.e., the solvent is introduced at the settling stage where the tailings are removed and the froth is introduced at the settling stage where the diluted bitumen is removed. The bitumen product may be sent to a solvent recovery unit where the solvent is separated from the bitumen to be recycled back to the process. The final bitumen product may be hydrocracked to break complex organic hydrocarbons into lighter hydrocarbons that are more suitable for further processing. The tailings from the CCD circuit include precipitated asphaltenes, water, and mineral solids, as well as a small amount of residual bitumen. The tailings are processed to recover the solvent and then sent to a tailings pond.

Any suitable organic solvent may be used to extract the bitumen. In one embodiment, the solvent may include paraffinic hydrocarbons having four to eight carbon atoms. The paraffinic hydrocarbons may include cycloalkanes and isoalkanes. In another embodiment, suitable solvents may include one or more alkanes having 3 to 10 carbon atoms or, desirably, one or more alkanes having 4 to 8 carbon atoms. For example, the solvent may include n-pentane, 2-methylbutane, 2,2-dimethylpropane, n-hexane, 2-methylpentane, 3-methylpentane, 2,3-dimethylbutane, 2,2-dimethylbutane, n-heptane, 2-methylhexane, 3-methylhexane, 2,2-dimethylpentane, 2,3-dimethylpentane, 2,4-dimethylpentane, 3,3-dimethylpentane, 3-ethylpentane, and/or 2,2,3-trimethylbutane. The solvent may also, include cycloalkanes and isoalkanes. Preferably, the solvent includes n-pentane, 2-methylbutane, n-hexane, 2-methylpentane, 3-methylpentane, and/or n-heptane. In one embodiment, the solvent may include 25 wt. % n-pentane, 25 wt. % 2-methylbutane, 25 wt. % 2-methylpentane, and 25 wt. % 3-methylpentane. The ratio of solvent to bitumen may be 6:1 to 2:1 or, preferably, 4:1 to 3:1. It should be appreciated that the solvent may be distinguished from the bitumen material based on characteristics such as molecular weight, boiling point, etc. Thus, the solvent is generally considered a separate component from the larger bitumen compounds.

The tailings are further processed to remove and recover the solvent that is present. It is desirable to separate the solvent from the tailings for a variety of reasons. Separating the solvent allows it to be recycled back to the bitumen extraction process. Also, environmental regulations limit the amount of solvent that can be discharged to the environment. Any excess solvent must be recovered from the tailings before it is discharged. The tailings may include about 1 wt. % to 20 wt. % solvent or 2 wt. % to 5 wt. % solvent. As already mentioned above, the solvent in the tailings can be classified as free solvent or bound solvent. The bound solvent is solvent that is coupled to the precipitated asphaltenes and/or, to a much lesser extent, other mineral solids. The bound solvent is generally recovered along with the precipitated asphaltenes. Free solvent is generally recovered with the tailings solvent recovery unit.

The following describes a variety of embodiments of systems and methods for separating the tailings. Although the following subject matter is described primarily in the context of separating tailings, it should be understood that the concepts and features described herein may be applicable to and used in a variety of settings and situations during processing of oil sands. Also, it should be understood, that the features, advantages, characteristics, etc. of one embodiment may be applied to any other embodiment to form an additional embodiment unless noted otherwise.

The various embodiments for separating the tailings may provide a number of advantages. For example, the tailings solvent recovery unit may use a negative pressure separation apparatus instead of a conventional steam stripping unit. The energy demands and high equipment wear rates of steam stripping made it expensive to operate. The energy demands required by steam stripping arise from the need to generate enough steam to not only strip the volatile organic solvent from the remainder of the phases (e.g., aqueous and asphaltenes phase), but also to preheat the stream and the stripping medium to the boiling point. The elimination of the steam stripping unit results in significant operating cost savings. Also, the tailings solvent recovery unit may experience much less wear than a conventional steam stripping unit thereby further decreasing maintenance and equipment costs.

In order to increase the solvent recovery or reduce the amount of solvent reporting to the tails to be discharged into the tailings pond or otherwise improve the economics of the process, the tailings may be separated one or more times in series with a cyclonic separation apparatus and/or a gravity separation apparatus. This may result in a solvent recovery of, for example, at least about 90 wt. %, at least about 95 wt. %, or, desirably, at least about 97 wt. %. In multiple stages these process can achieve solvent recovery of at least about 99 wt. %. Due to the higher initial separation, the steam stripping may be substituted with a less expensive solvent recovery process such as vacuum stripping. In comparison to the conventional tailings solvent recovery units, these separation apparatuses typically require significantly less heat and many can be carried out at ambient temperatures. The tailings (primarily water) that exit after the solvent is recovered may generally have a temperature of about 25° C. to 45° C., which is much lower than the temperature achieved from conventional processing.

The cyclonic separation apparatus may be used to separate the tailings into a light component that is enriched with the free solvent, precipitated asphaltenes, and includes most of the water contained in the feed. The heavy component is generally enriched with the mineral solids and contains a minimum amount of water. Alternatively, the tailings may be separated with a cyclonic separation apparatus so that the heavy component is enriched with the precipitated asphaltenes. In this embodiment, the light component is enriched with the free solvent and contains some water and some small amount of precipitated asphaltenes while the heavy component is enriched with the mineral solids and the precipitated asphaltenes. In some embodiments, the light component and/or the heavy component obtained from the initial separation apparatus may be subjected to one or more stages of further cyclonic or gravity separation at a different cut size to separate the different materials, e.g. separate asphaltene phase and water plus solvent phase. The water plus solvent may be separated in a gravity separation apparatus such as a settler to allow separation of the two immiscible liquids. The solvent layer is clean enough to be recycled back to the process without any further separation. The water phase may be sent through the tailings solvent recovery unit to remove residual quantities of solvent.

It should be appreciated that any of a number of cyclonic separation apparatuses and/or gravity separation apparatuses may be used. One example of a cyclonic separation apparatus may include a hydrocyclone or hydroclone. In some implementations, the separations are customized to the special characteristics of the mixture being processed. For example, various characteristics of the hydrocyclone such as the cyclone size, vortex finder, and apex, can be modified to alter which materials are sent to the light component and which materials are sent to the heavy component. Thus, the particular hydrocyclone can be matched to any particular slurry to ensure the optimum separation is achieved and that, the solvent is concentrated for recovery. The separations also can be customized to accommodate any suitable processing scheme such as continuous, batch, or semi-batch processing.

A cyclonic separation apparatus is configured to induce or facilitate cyclonic spinning of one or more source streams in a vessel, which is typically conically shaped. The resulting radial or centrifugal force causes the heavier or denser materials suspended in the stream to collect in a heavy component or underflow and the lighter or less dense materials in, the stream to collect in a light component or overflow. It should be appreciated that the user of the terms overflow and underflow are not necessarily meant to signify the location of where the stream exits the separation apparatus, but instead are meant as, commonly understood proxy terms for light component and heavy component. Mineral solids can be separated from the water and/or other materials in the heavy component by, for example, a gravity separation process such as settling. The water then can be recycled back into the process or disposed of. The light component can be separately routed for collection or further processing.

In one embodiment, the cyclonic separation apparatus may include a gas-sparged hydrocyclone. Like other cyclonic separation apparatuses, gas-sparged hydrocyclones involve spinning the stream through the apparatus cyclonically. Gas-sparged hydrocyclones, however, can also include introducing fine gas bubbles into the source stream while centrifugal force is being applied. The bubbles can be introduced through fine holes in the walls of a pipe positioned vertically in the center of the hydrocyclone. Introducing these bubbles further promotes separation by the flotation principles discussed herein. The gas can be, for example, air or an inert gas such as nitrogen.

The cyclonic separation apparatus can be used, for example, to remove mineral solids and/or other heavy materials from a stream prior to separating the solvent from the other liquid components in the tailings. As already mentioned, separating the mineral solids at various points may facilitate improved operation of downstream equipment. When performed on the tailings, the heavy component exiting the cyclonic separation apparatus can include mineral solids and water or alternatively can include mineral solids, precipitated asphaltenes, and water. In one embodiment, the tailings described above may be separated so that the heavy component includes about 40 wt. % to 70 wt. % mineral solids, about 0.1 wt. % to 10 wt. % asphaltenes (depending on whether it is desired for asphaltenes to be sent to the heavy component), no more than about 0.5 wt. % free solvent (solvent that is not bound to the asphaltenes or mineral solids), and the remainder is water. The light component may include solvent and water or alternatively, solvent, water, and precipitated asphaltenes (depending on whether it is desired for asphaltenes to report to the light component). In one embodiment, the light component may include about 0 wt. % to 5 wt. % mineral solids, about 10 wt. % to 40 wt. % precipitated asphaltenes, about 0.5 wt. % to 20 wt. % solvent, and the remainder is water.

Some disclosed embodiments include one or more gravity separation processes. Typically, the gravity separation processes are used after the tailings have been separated in a cyclonic separation process. However, it is contemplated that the gravity separation processes may be used on the tailings before any cyclonic separation processes are used. Gravity separation apparatuses can be used, for example, to separate the tailings into a light component that includes a majority of the free solvent and a heavy component that includes the mineral solids. Gravity separation apparatuses may be used in series to provide effective yet inexpensive separation of the tailings. Reagents can be added to enhance the separation of the two phases. Attrition scrubbing can be used to clean the mineral surfaces, thereby enhancing the separation. Useful reagents for separating the tailings include, for example, dispersants, surfactants and solvents. These reagents facilitate the separation, for example, by surface charge alteration and dispersion. In some embodiments, the dispersant comprises a silicate, a phosphate, a citrate, a lignin sulfonate, or a combination or derivative thereof. Suitable gravity separation apparatuses include settlers, clarifiers, flotation apparatuses, flocculation, hydroseparator, and the like.

One embodiment of a gravity separation process is a flotation process. In general, flotation can cover a variety of different processes such as separation due to immiscible phases, froth generation, etc. A flotation apparatus can be used to separate precipitated asphaltenes and certain target minerals from other materials in the tailings. The target minerals can include valuable minerals, such as titania, ilmenite and zirconia, as well as minerals that may be harmful to the environment, such as sulfur-containing minerals.

Multiple flotation stages can be used to increase the recovery of the targeted material. For example, some embodiments include a rougher stage to effect an initial or rough separation targeting high recovery, a scavenger stage to scavenge any remaining hydrophobic component and a cleaner stage to clean any one of the rougher or scavenger stage products of the hydrophobic component to higher purity. Each successive stage can be configured and optimized to the recovery of diminishing concentrations of one or more hydrophobic components. Recirculation, recycle or re-treatment of some streams and products also can be included.

As a final step, the tailings solvent recovery unit may be used to separate a solvent and water mixture obtained from the various cyclonic separation apparatuses and/or gravity separation apparatuses. In one embodiment, the tailings solvent recovery unit may be a negative pressure separation apparatus such as a vacuum distillation apparatus or a vacuum stripping apparatus. The advantage of vacuum stripping is that the volatile organic solvent volatilizes at a lower temperature when the pressure is reduced. The negative pressure separation apparatus may also include one or more vacuum filters (e.g., belt filter, plat and frame filter, etc.) It should be appreciated that in addition to the primary unit operations described above, embodiments of the disclosed method and system can include secondary unit operations, such as pumps, plenums and regulators.

Turning now to the FIGS., it should be appreciated that the tailings 110 originate from a CCD extraction process such as that described in the '709 patent even though the details of the extraction process are not explicitly described herein (although the entire '709 patent is incorporated herein by reference). The tailings include precipitated asphaltenes, solvent, mineral solids, and water, as described above. Turning to FIG. 1, it should be appreciated that the process shown therein is particularly suitable for separating the tailings from a low temperature froth treatment system (froth treatment process operated at an ambient temperature of approximately 2° C.). Of course, the process shown in FIG. 1 may also be used to treat tailings from any suitable process.

The tailings 110 that exit the extraction process can be routed directly into a first separation apparatus 112, such as a hydrocyclone. The separation apparatus 112 can be useful, for example, to separate mineral solids 114 (also referred to herein as coarse solids) from the tailings 110 to produce a first light component or first overflow 116 that is enriched with solvent and precipitated asphaltenes. A first heavy component or first underflow 118 enriched with the heavy materials such as the mineral solids exits the separation apparatus 112 and is routed to a second separation apparatus 120. The second separation apparatus is preferably a hydrocyclone but may be any other suitable cyclonic separation apparatus or gravity separation apparatus. The second separation apparatus 120 divides the stream into a second light component or second overflow 122 and a second heavy component or second underflow that is primarily mineral solids 114 that are disposed of. The second light component 122 is recombined with the first light component 116 and both are routed to a third separation apparatus 124, which may be a hydrocyclone, or to a settler/clarifier 125 to separate the precipitated asphaltenes 126 from the water 128 and the solid residue 130. The solvent-water phase can then be treated in a recovery unit 132 for the recovery of solvent 134. The recovery unit 132 may be a negative pressure separation apparatus. For example, the recovery unit 132 may be a vacuum stripping unit. The asphaltenes 126 may be processed further as described in the '327 Application. The inorganic solids 114 may also be passed through a recovery unit 132 such as a vacuum stripping unit to produce a final tailings product that has no more than 500 ppm solvent.

Figure 2:
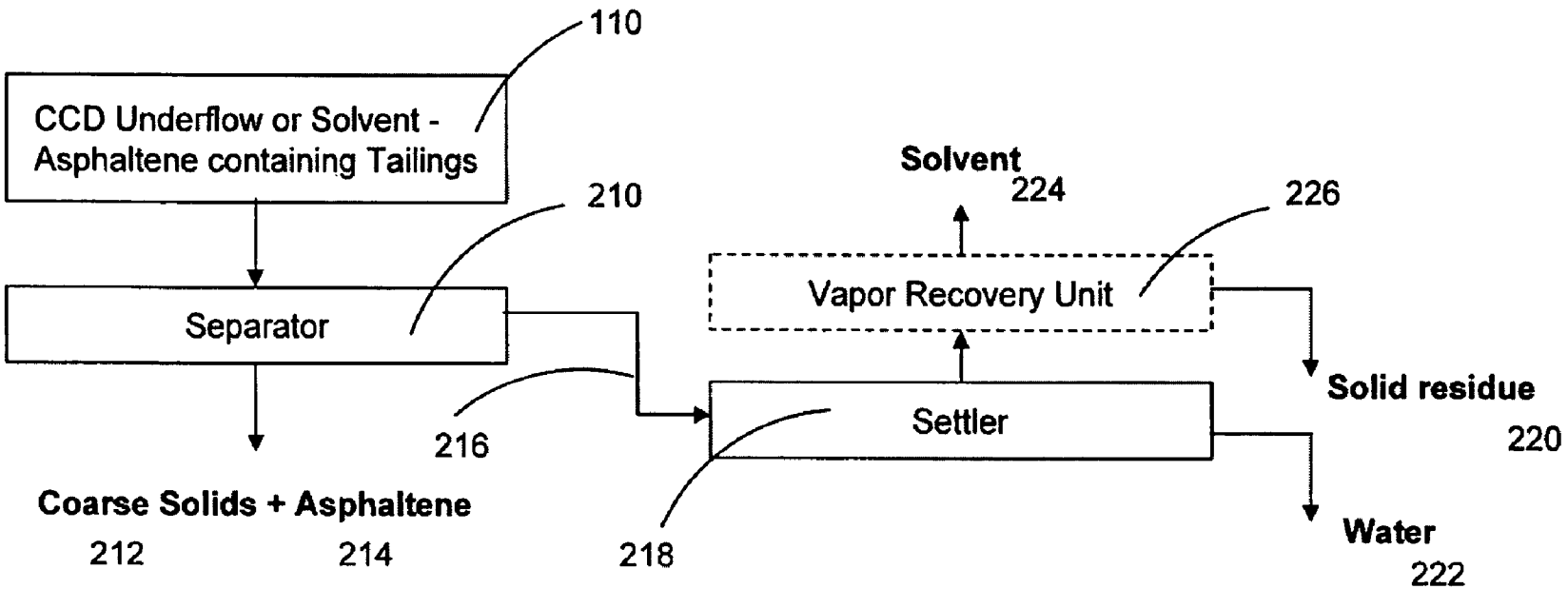
FIG. 2 is a schematics diagram representing embodiments of a method and a system for recovering solvent or diluent from tailings produced using from a High temperature Froth Treatment Process (HTFT).

FIG. 2 shows another embodiment of a process that may be used to recover solvent from tailings. This process may be especially useful in connection with tailings obtained from a high temperature froth treatment process (froth treatment process operated at an elevated temperature of approximately 70° C.). As shown in FIG. 2, the tailings 110 can be routed into a first separation apparatus 210, such as a hydrocyclone. In this embodiment, the separation apparatus 210 is configured to separate the tailings so that the asphaltenes 214 and mineral solids 212 are enriched in the heavy component. The solvent is enriched in the first light component or first overflow 216. The light component 216 may be routed to another gravity separation apparatus 218 to further separate the water 222. The separation apparatus 218 may be a hydrocyclone, settler, or clarifier. The solvent 224 can be recovered using a recovery unit 226, which may be similar to the recovery unit 132.

Figure 3:
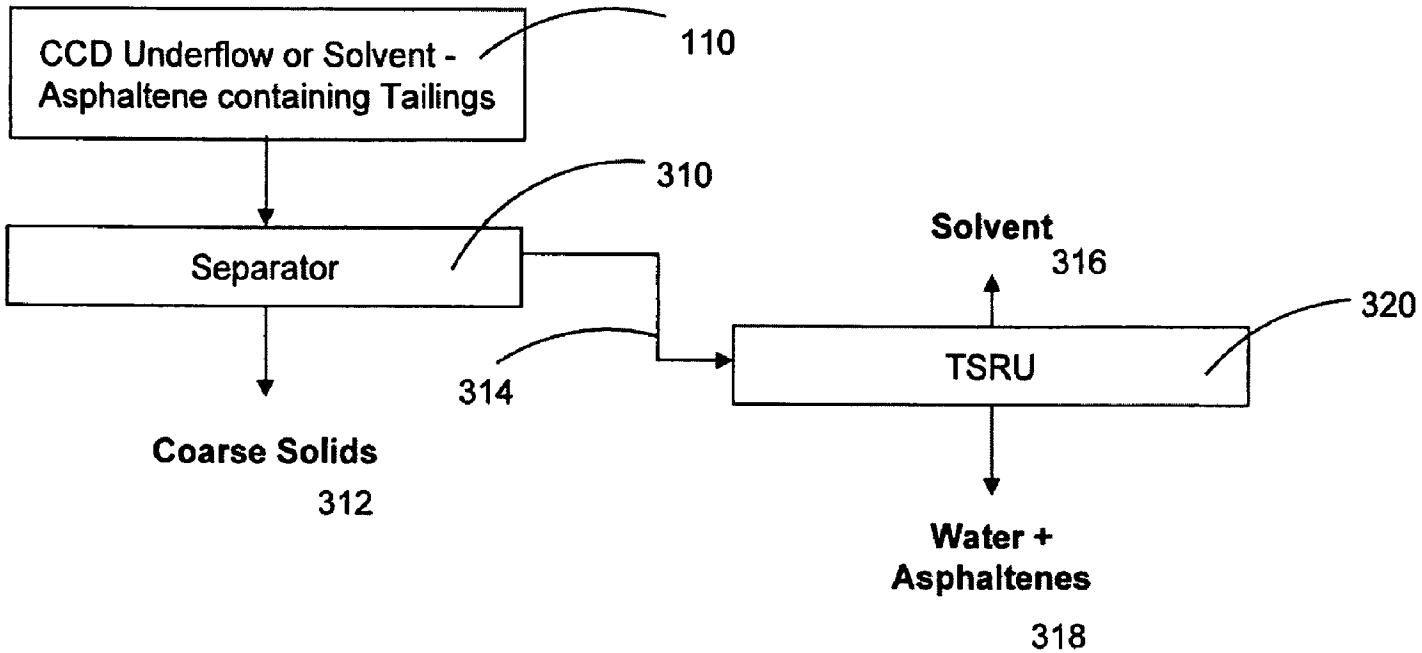
FIG. 3 is a schematic diagram representing embodiments of a method and a system for removing solids from tailings prior to separating the solvent with a distillation apparatus such as a steam stripping apparatus or vacuum stripping apparatus.

With reference to FIG. 3, the tailings 110 can, alternatively, be routed directly into a separation apparatus 310, such as a hydrocyclone. The separation apparatus 310 can be used to separate mineral solids 312 and asphaltenes from the tailings 110 to the heavy component. This embodiment is more applicable to oil sands processing where the asphaltenes are coarse and or coated onto minerals and hence have a natural tendency to be readily free settling. The light component 314 can be routed to another separator (not depicted), such as a hydrocyclone, or settler/clarifier (not depicted) to remove fine suspended solids and produce a solvent-water stream. The solvent 316 can be recovered from the water stream 318 through the use of a recovery unit 320 that is similar to the recover units described in connection with FIGS. 1 and 2.

Figure 4:
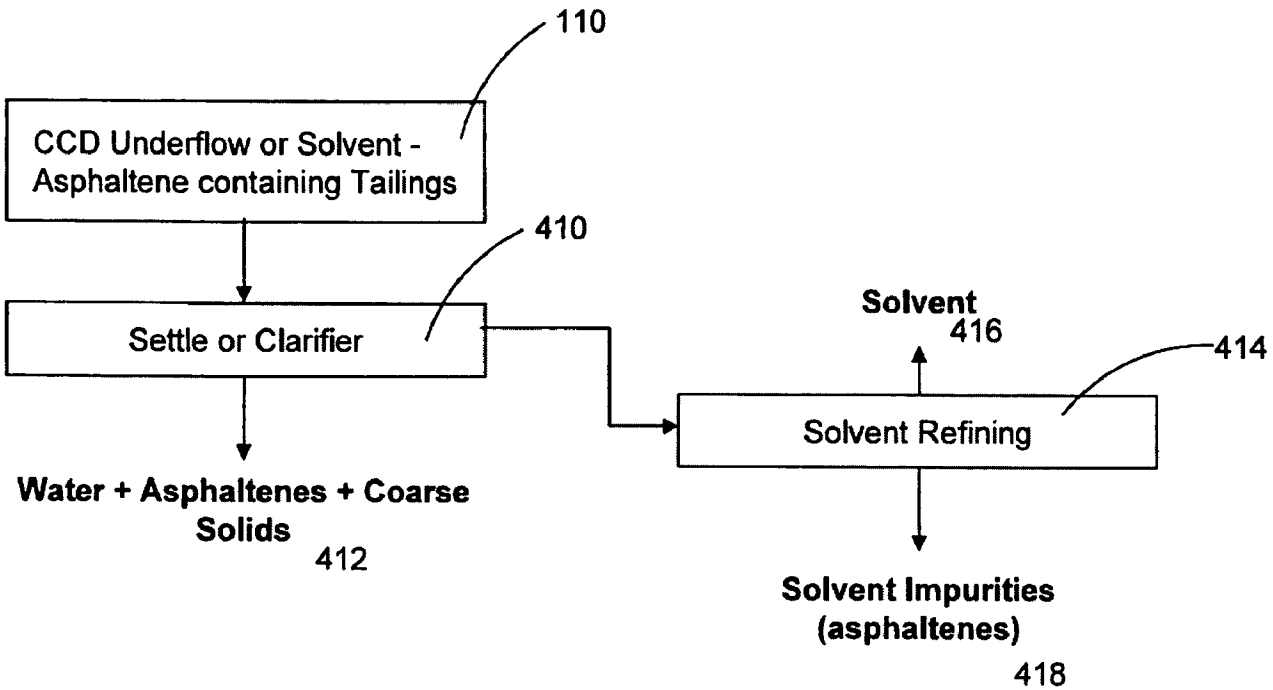
FIG. 4 is a schematic diagram representing embodiments of a method and a system for recovering solvent from tailings by gravity separation in a settler or clarifier. The concentrated solvent layer is removed (continuous process) and may be further refined for solvent recovery with a distillation apparatus.

Turning to FIG. 4, the tailings 110 can be routed directly into a separation apparatus 410 that is a gravity separation apparatus. The separation apparatus 410 can be useful, for example, to separate mineral solids 412, asphaltenes, and water from the tailings 110. The separation apparatus 410 provides a useful way to remove these materials before sending the solvent/water stream to the recovery unit 414. The heavy component 412 from the separation apparatus 410 can exit the separation apparatus and be routed to a gravity separation apparatus (not depicted) to scavenge any remaining solvent and asphaltenes. The light component from this separation apparatus can be recombined with the light component from the separation apparatus 410 and both routed to the recovery unit 414 for the recovery of the solvent 416.

It should be appreciated that the number and configuration of the separation apparatuses may be varied in a number of different ways. For example, multiple separation apparatuses may be placed in series or in parallel to provide the desired purity of the solvent. Also, any of the embodiments shown in the FIGS. may be modified to include additional cyclonic separation apparatuses and/or gravity separation apparatuses to further facilitate separation of the solvent.

EXAMPLES

The following examples are provided to further illustrate the subject matter disclosed herein. The examples describe lab scale tests of some of the embodiments of the separation system disclosed herein. The lab scale tests demonstrate the feasibility of efficiently and effectively separating solvent from oil sands tailings that include precipitated asphaltenes. The tailings tested in the following examples were obtained from the underflow of a CCD process described above. The solvent used in the CCD process was a C5-C6 solvent (e.g., pentane, hexane, and the like). The higher volatility solvent (C5-C6 solvent) was removed from the tailings and replaced with a lower volatility solvent (C7 solvent) to make it easier to run the tests on a lab scale. The examples should not be considered as being limiting in any way.

Example 1

A hydrocyclone was used to separate solvent from the tailings generated as part of the process of recovering hydrocarbons from oil sands. The tailings included approximately 5 wt. % heptane (the solvent) 25 wt. % solids, and the remainder was water. The solids include asphaltenes and mineral solids (the ratio of asphaltenes to mineral solids was approximately 1:1) as well as clay. The heptane precipitated the asphaltenes so that they were part of the solids fraction of the tailings.

The tailings were initially separated with a Krebs 2 inch hydrocyclone (model U2-GMAX). This bench scale hydrocyclone was used to demonstrate the feasibility of this approach. It should be appreciated, of course, that larger, ceramic lined hydrocyclones may be used at a commercial level. The tailings were stored in a closed vessel that functioned as the feed storage tank. A centrifugal pump was connected to a variable frequency drive to feed the tailings into the hydrocyclone at a pressure of 10 psi to 20 psi. Additional vessels were provided to collect the hydrocyclone products (light component or overflow and heavy component or underflow). Each test was run with 20 liters of tailings.

The hydrocyclone was configured to separate the free solvent and asphaltenes (i.e., the hydrocarbon components) into the light component and the mineral solids into the heavy component. The results are shown in Table 1 and Table 2 below. The solvent recovery for the run shown in Table 1 is 90% to the light component. It should be noted, however, that the tailings used in this run were "aged" longer than tailings from a typical oil sands recovery process. Over prolonged contact times, the asphaltenes absorbs and physically binds increasing amounts of solvent. The test rest shown in Table 2 used tailings that were aged for an amount of time that is closer to the actual contact time of asphaltenes and solvent in a typical oil sands recovery process. The results show that the separation efficiency for these runs is greater than that of the aged tailings despite the relatively low levels of solvent used. It can also be seen that the separation efficiency generally increases with increased solvent concentration in the feed.

TABLE 1

Aged Tailings Separation Data

| | Mass | Composition (wt. %) | | | Recovery (%) | | | |
|---|---|---|---|---|---|---|---|---|
| | Split (%) | Solids | Carbon | Heptane | Water | Solids | Carbon | Heptane |
| Feed | 100 | 19.1 | 28 | 0.65 | 100 | 100 | 100 | 100 |
| Light | 88.5 | 14.3 | 36 | 0.66 | 94 | 66 | 81 | 90 |
| Heavy | 11.5 | 56.4 | 1.4 | 0.56 | 6 | 34 | 19 | 10 |

TABLE 2

| Tailings Separation Data | | | | | | | | |
|---|---|---|---|---|---|---|---|---|
| | Mass | Heptane (wt. %) | | | Water Recovery (%) | Heptane Recovery (%) | | |
| | Split (%) | Run 2 | Run 3 | Run 4 | All Runs | Run 2 | Run 3 | Run 4 |
| Feed | 100 | 0.58 | 0.63 | 0.65 | 100 | 100 | 100 | 100 |
| Light | 88.5 | 0.61 | 0.66 | 0.66 | 94 | 92 | 94 | 89 |
| Heavy | 11.5 | 0.42 | 0.35 | 0.42 | 6 | 8 | 6 | 11 |

Example 2

A Krebs 1 inch hydrocyclone was used to further separate the asphaltenes and solvent from the mineral solids in the heavy component obtained in Example 1. It should be appreciated that the feed includes some additional water that was added after the initial separation. It is desirable to separate the asphaltenes so that the solvent bound to the asphaltenes can be separated from the mineral solids. The results of this separation operation are shown in Table 3 below. The combination of hydrocyclones from Example 1 and 2 in series result in approximately 99% recovery of the solvent.

TABLE 3

| Separation Data of the Heavy Component from Example 1 | | | | | | | | |
|---|---|---|---|---|---|---|---|---|
| | Mass | Composition (wt. %) | | | Recovery (%) | | | |
| | Split (%) | Solids | Carbon | Heptane | Water | Solids | Carbon | Heptane |
| Feed | 100 | 18 | 14 | 0.56 | 100 | 100 | 100 | 100 |
| Light | 86 | 10 | 26 | 0.55 | 94 | 48 | 86 | 92 |
| Heavy | 14 | 66 | 3 | 0.32 | 6 | 52 | 14 | 8 |

Example 3

A Krebs 1 inch hydrocyclone was used to separate the asphaltenes from the solvent and water in the light component obtained in Example 1. The feed stream was diluted with some additional water used to rinse the equipment from Example 1 to recover all of the solvent. The results of this separation operation are shown in Table 4 below. It should be noted that as the solvent content of the feed increases the solvent recovery efficiency also increases due to the fact that the asphaltenes absorb a background threshold amount of solvent. The amount of solvent in the heavy component remains at a level of 0.37-0.41 in the elevated feed solvent content tests, which is comparable to that of the lower solvent content feed Examples 1 and 2.

TABLE 4

| Separation Data of the Light Component from Example 1 | | | | | | | |
|---|---|---|---|---|---|---|---|
| | Mass | | Heptane (wt. %) | | Water Recovery (%) | Heptane Recovery (%) | |
| | Split (%) | Solids (%) | Run 5 | Run 6 | All Runs | Run 5 | Run 6 |
| Feed | 100 | 12.5 | 8.3 | 2.6 | 100 | 100 | 100 |
| Light | 67.5 | 9.5 | 12.2 | 3.8 | 70 | 99 | 95 |
| Heavy | 32.5 | 18.5 | 0.41 | 0.37 | 30 | 1 | 5 |

Illustrative Embodiments

Reference is made in the following to a number of illustrative embodiments of the subject matter described herein. The following embodiments illustrate only a few selected embodiments that may include the various features, characteristics, and advantages of the subject matter as presently described. Accordingly, the following embodiments should not be considered as being comprehensive of all of the possible embodiments. Also, features and characteristics of one embodiment may and should be interpreted to equally apply to other embodiments or be used in combination with any number of other features from the various embodiments to provide further additional embodiments, which may describe subject matter having a scope that varies (e.g., broader, etc.) from the particular embodiments explained below. Accordingly, any combination of any of the subject matter described herein is contemplated.

According to one embodiment, a method comprises: separating tailings resulting from a process for recovering bitumen from oil sands into a first light component and a first heavy component with a cyclonic separation apparatus or a gravity separation apparatus, the first light component including a majority of free hydrocarbon solvent in the tailings and a majority of asphaltenes in the tailings and the first heavy component including mineral solids; and separating the first light component into a second light component and a second heavy component with a cyclonic separation apparatus or a gravity separation apparatus, the second light component including a majority of the free hydrocarbon solvent in the first light component and the second heavy component including a majority of the asphaltenes in the first light component. A majority of the asphaltenes in the tailings have precipitated. The hydrocarbon solvent may include at least 50 wt. % paraffinic hydrocarbons. The paraffinic hydrocarbons may have five to eight carbon atoms. The method may comprise separating the tailings into the first light component and the first heavy component with a hydrocyclone. The method may comprise separating the first light component into a second light component and a second heavy component with a hydrocyclone. The method may comprise separating the first heavy component into a third light component and a third heavy component with a cyclonic separation apparatus or a gravity separation apparatus, the third light component including a majority of the free hydrocarbon solvent in the first heavy component and a majority of the asphaltenes in the first heavy component. The method may comprise separating the hydrocarbon solvent from the second light component with a distillation apparatus. The distillation apparatus may be a negative pressure distillation apparatus. The method may comprise separating the hydrocarbon solvent from the second light component with a negative pressure separation apparatus.

According to another embodiment, a method comprises: separating a slurry that is part of a process for recovering bitumen from oil sands with a hydrocyclone, the slurry including asphaltenes; wherein a majority of the asphaltenes in the slurry have precipitated. The slurry may include hydrocarbon solvent that is at least 50 wt. % paraffinic hydrocarbons. The slurry may include hydrocarbon solvent that has a boiling point of no more than 120° C. At least 80 wt. % of the asphaltenes in the slurry have precipitated. The slurry may be separated into a light component that includes a majority of free hydrocarbon solvent and a heavy component. The slurry may be separated into a plurality of components by the hydrocyclone and wherein at least one of the plurality of components is separated further by another hydrocyclone.

According to another embodiment, a method comprises: separating bitumen from oil sands and thereby forming tailings; separating the tailings into a light component and a heavy component with a hydrocyclone. The tailings may be a slurry. The tailings may include precipitated asphaltene. The method may comprise separating the light component with a hydrocyclone. The method may comprise separating the heavy component with a hydrocyclone. The light component, may include a majority of free hydrocarbon solvent in the tailings and a majority of precipitated asphaltenes in the tailings and the heavy component includes mineral solids.

According to another embodiment, a method comprises: separating a stream that is part of a process for recovering bitumen from oil sands with a hydrocyclone, the stream including a hydrocarbon solvent; wherein the hydrocarbon solvent includes at least 50 wt. % paraffinic hydrocarbons having five to eight carbon atoms. The hydrocarbon solvent may have a boiling point that is no more than 120° C. The hydrocarbon solvent may have a boiling point that is no more than 100° C. The hydrocarbon solvent may include at least 50 wt. % of n-pentane, 2-methylbutane, n-hexane, 2-methylpentane, 3-methylpentane, and/or n-heptane. The stream may include precipitated asphaltenes. The stream may be separated into a light component that includes a majority of the hydrocarbon solvent that is free and a heavy component. The stream may be separated into a plurality of components by the hydrocyclone and wherein at least one of the plurality of components may be separated further by another hydrocyclone.

According to another embodiment, a separation system comprises: one or more separation apparatuses configured to receive and separate bitumen from oil sands and thereby produce tailings that include hydrocarbon solvent and precipitated asphaltenes; and a hydrocyclone positioned to receive the tailings and separate the tailings into a light component and a heavy component. The light component may include a majority of free hydrocarbon solvent in the tailings. The hydrocarbon solvent may include at least 50 wt. % paraffinic hydrocarbons. The paraffinic hydrocarbons may have five to eight carbon atoms. The separation system may comprise another hydrocyclone positioned to receive the light component and separate the light component into another light component and a another heavy component. The separation system may comprise another hydrocyclone positioned to receive the heavy component and separate the heavy component into another light component and another heavy component. The separation system may comprise a distillation apparatus positioned to receive the light component and separate the hydrocarbon solvent from the light component. The distillation column may be a vacuum distillation apparatus. The separation system may comprise a negative pressure separation apparatus positioned to receive the light component and separate the hydrocarbon solvent from the light component.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include, one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from, 1 to 10 (e.g., 3, 5.8, 9.9994, and so forth).

What is claimed is:

1. A method comprising:

separating tailings resulting from a process for recovering bitumen from oil sands into a first light component and a first heavy component with a cyclonic separation apparatus or a gravity separation apparatus, the first light component including a majority of free hydrocarbon solvent in the tailings and a majority of precipitated asphaltenes in the tailings and the first heavy component including mineral solids; and separating the first light component into a second light component and a second heavy component with a cyclonic separation apparatus or a gravity separation apparatus, the second light component including a majority of the free hydrocarbon solvent in the first light component and the second heavy component including a majority of the precipitated asphaltenes in the first light component.

2. The method of claim 1 wherein the free hydrocarbon solvent includes at least 50 wt % paraffinic hydrocarbons.

3. The method of claim 2 wherein the paraffinic hydrocarbons have five to eight carbon atoms.

4. The method of claim 1 comprising separating the tailings into the first light component and the first heavy component with a hydrocyclone.

5. The method of claim 1 comprising separating the first light component into a second light component and a second heavy component with a hydrocyclone.

6. The method of claim 1 comprising separating the first heavy component into a third light component and a third heavy component with a cyclonic separation apparatus, a gravity separation apparatus, and/or a negative pressure separation apparatus, the third light component including a majority of the free hydrocarbon solvent in the first heavy component and a majority of the precipitated asphaltenes in the first heavy component.

7. The method of claim 1 comprising separating the free hydrocarbon solvent from the second light component with a negative pressure separation apparatus.

8. The method of claim 7 wherein the negative pressure separation apparatus is a negative pressure stripping apparatus.

9. A method comprising:

separating a slurry that is part of a process for recovering bitumen from oil sands with a hydrocyclone, the slurry including free hydrocarbon solvent and asphaltenes;

wherein a majority of the asphaltenes in the slurry have precipitated, and wherein the slurry is separated into a light component that includes a majority of the free hydrocarbon solvent in the slurry and a heavy component.

10. The method of claim 9 wherein the hydrocarbon solvent includes at least 50 wt % paraffinic hydrocarbons.

11. The method of claim 9 wherein the hydrocarbon solvent has a boiling point of no more than 120° C.

12. The method of claim 9 wherein the slurry is separated into a plurality of components by the hydrocyclone, and wherein at least one of the plurality of components is separated further by another hydrocyclone.

13. The method of claim 9 wherein the slurry is separated into a light component that includes a majority of the free hydrocarbon solvent and a heavy component; the method comprising separating the free hydrocarbon solvent from the light component with a negative pressure separation apparatus.

14. The method of claim 13 wherein the negative pressure separation apparatus is a negative pressure stripping apparatus.

15. A method comprising:

separating bitumen from oil sands and thereby forming tailings which include free hydrocarbon solvent and precipitated asphaltenes;

separating the tailings into a light component and a heavy component with a hydrocyclone, wherein the light component includes a majority of the free hydrocarbon solvent in the tailings and a majority of precipitated asphaltenes in the tailings and the heavy component includes mineral solids.

16. The method of claim 15 comprising separating the light component with a hydrocyclone.

17. The method of claim 15 comprising separating the heavy component with a hydrocyclone.

18. The method of claim 15 wherein the light component that includes a majority of the free hydrocarbon solvent; the method comprising separating the free hydrocarbon solvent from the light component with a negative pressure separation apparatus.

19. The method of claim 18 wherein the negative pressure separation apparatus is a negative pressure stripping apparatus.

20. A method comprising:

separating bitumen from oil sands and thereby forming tailings which include free hydrocarbon solvent and precipitated asphaltenes;

separating the tailings into a light component that includes a majority of the free hydrocarbon solvent and a heavy component; and separating the free hydrocarbon solvent from the light component with a negative pressure separation apparatus.

21. The method of claim 20 wherein the negative pressure separation apparatus is a negative pressure stripping apparatus.

22. The method of claim 20 comprising separating the heavy component with a negative pressure separation apparatus to remove additional hydrocarbon solvent from the heavy component.

23. The method of claim 20 comprising separating the tailings into the light component and the heavy component with a hydrocyclone.

24. The method of claim 1, wherein the first light component further includes a majority of water in the tailings.

25. The method of claim 9, wherein the slurry further includes water and wherein the light component further includes a majority of the water in the slurry.

26. The method of claim 15, wherein the tailings further include water and wherein the light component further includes a majority of the water in the tailings.

27. The method of claim 20, wherein the tailings further include water and where the light component further includes a majority of the water in the tailings.

* * * * *